US005096875A

United States Patent [19]

Martin

[11] Patent Number: 5,096,875

[45] Date of Patent: Mar. 17, 1992

[54] THERMAL DYE TRANSFER RECEIVING ELEMENT WITH BACKING LAYER

[75] Inventor: Thomas W. Martin, Rochester, N.Y.

[73] Assignee: Eastman Kodak Company, Rochester, N.Y.

[21] Appl. No.: 547,580

[22] Filed: Jun. 28, 1990

[51] Int. Cl.[5] ..... B41M 5/035; B41M 5/26

[52] U.S. Cl. ..... 503/227; 8/471; 428/195; 428/211; 428/327; 428/331; 428/913; 428/914

[58] Field of Search ..... 8/471; 428/195, 323, 428/327, 331, 913, 914, 211; 503/227

[56] References Cited

U.S. PATENT DOCUMENTS

| | | | |
|---|---|---|---|
| 4,814,321 | 3/1989 | Campbell | 503/227 |
| 4,820,686 | 4/1989 | Ito et al. | 503/227 |
| 4,828,971 | 5/1989 | Przezdziecki | 430/531 |

FOREIGN PATENT DOCUMENTS

| | | | |
|---|---|---|---|
| 0351075 | 1/1990 | European Pat. Off. | 503/227 |
| 01047586 | 2/1989 | Japan | 503/227 |

OTHER PUBLICATIONS

U.S. Ser. No. 07/485,676 of Harrison, filed Feb. 27, 1990.

*Primary Examiner*—Bruce H. Hess
*Attorney, Agent, or Firm*—Andrew J. Anderson

[57] ABSTRACT

A dye-receiving element for thermal dye transfer includes a support having on one side thereof a polymeric dye image-receiving layer and on the other side thereof a backing layer made from a mixture of polyethylene oxide, submicron colloidal inorganic particles, and polymeric particles of a size larger than the inorganic particles.

20 Claims, No Drawings

THERMAL DYE TRANSFER RECEIVING ELEMENT WITH BACKING LAYER

This invention relates to dye-receiving elements used in thermal dye transfer, and more particularly to the backing layer of such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye receiving elements for thermal dye transfer generally include a support bearing on one side thereof a dye image-receiving layer and on the other side thereof a backing layer. As set forth in copending, commonly assigned U.S. Ser. No. 485,676 of Harrison, filed Feb. 27, 1990, now U.S. Pat. No. 5,011,814, the disclosure of which is incorporated by reference, the backing layer material is chosen to (1) provide adequate friction to a thermal printer rubber pick roller to allow for removal of one receiver element at a time from a thermal printer receiver element supply stack, (2) minimize interactions between the front and back surfaces of receiving elements such as dye retransfer from one imaged receiving element to the backing layer of an adjacent receiving element in a stack of imaged elements, and (3) minimize sticking between a dye-donor element and the receiving element backing layer when the receiving element is accidentally inserted into a thermal printer wrong side up.

One backing layer which has found use for dye-receiving elements is a mixture of polyethylene glycol (a double-end hydroxy terminated ethylene oxide polymer) and submicron colloidal silica. This backing layer functions well to minimize interactions between the front and back surfaces of receiving elements and to minimize sticking to a dye-donor element when the receiving element is used wrong side up. This backing layer also provides adequate friction to a rubber pick roller to allow removal of receiving elements from a stack under normal room temperature conditions (20° C., 50% relative humidity). At higher temperatures and relative humidity, e.g. tropical conditions (30° C., 91% relative humidity), however, this backing layer becomes too lubricious and does not allow for effective removal of receiving elements from the supply stack.

U.S. Pat. No. 5,011,814 referred to above discloses a backing layer comprising a mixture of polyethylene oxide (a single-end hydroxy terminated ethylene oxide polymer) and submicron colloidal inorganic particles. By using polyethylene oxide in place of polyethylene glycol in the backing layer mixture, adequate friction is achieved between a rubber pick roller and the backing layer to allow for removal of receiver elements from a supply stack even under high temperature and relative humidity conditions.

While the use of backing layers comprising submicron colloidal inorganic polymers as described above have resulted in greater friction between the backing layer and rubber pick roller to enable removal of receiver elements from a supply stack, it has been found that a further problem of "blocking" or multiple feeding of receiver elements occasionally results due to too high friction between adjacent receiver elements in the supply stack when using receiver elements having such backing layers.

U.S. Pat. No. 4,814,321 of Campbell discloses use of antistatic backing layers having silicon dioxide particles of approximately 2 um diameter. Such particles are said to prevent fusing of the backing layer to a heated finishing roller. There is no disclosure of the use of such particles to improve picking friction or control blocking during feeding of receiver elements from a supply stack.

European Patent Application 0 35 1 075 describes backing layers that are said to provide good anti-blocking characteristics. These layers include colloidal particulate material of mean particle size from 5 to 250 nm. As discussed above, however, use of such submicron particles alone has been found to still occasionally result in blocking or multiple feeding from a supply stack.

Japanese Kokai 01/047,586 discloses the use of organic or inorganic grains of from 0.5 to 10 um dispersed in thermoplastic binders to form "coursened" layers on the front and/or back of receiver elements in order to prevent multiple feeding of receiver elements from a supply stack. No distinction is made between the use of inorganic and organic grains, and the effect of such grains on the picking roll friction is not discussed.

It would be desirable to provide a backing layer for a dye-receiving element which would minimize interactions between the front and back surfaces of such elements, minimize sticking to a dye-donor element, provide adequate friction to a thermal printer rubber pick roller to allow for removal of receiver elements from a receiver element supply stack, and control friction between adjacent receiver elements in the supply stack so as to prevent simultaneous multiple feeding of the receiver elements.

These and other objects are achieved in accordance with this invention which comprises a dye-receiving element for thermal dye transfer comprising a support having on one side thereof a polymeric dye image-receiving layer and on the other side thereof a backing layer, wherein the backing layer comprises a mixture of polyethylene oxide (a single-end hydroxy terminated particles, and polymeric particles of a size larger than the inorganic particles.

The process of forming a dye transfer image in a dye-receiving element in accordance with this invention comprises removing an individual dye-receiving element as described above from a supply stack of dye-receiving elements, moving the individual receiving element to a thermal printer printing station and into superposed relationship with a dye-donor element comprising a support having thereon a dye-containing layer so that the dye-containing layer of the donor element faces the dye image-receiving layer of the receiving element, and imagewise heating the dye-donor element thereby transferring a dye image to the individual receiving element. The process of the invention is applicable to any type of thermal printer, such as a resistive head thermal printer, a laser thermal printer, or an ultrasound thermal printer.

In accordance with this invention, it has been found that adding a polymeric particulate material of the indicated size decreases the sliding friction between adjacent receiving elements in a supply stack to a greater extent than the picking friction between the backing layer and a rubber picking roll. As a result, blocking or multiple feeding is controlled while adequate picking friction is maintained. Using polyethylene oxide in the backing layer mixture results in adequate friction between the rubber pick roller and the backing layer even under high temperature and relative humidity conditions. As set forth in above, in order to minimize accidental sticking to a dye-donor element, the mixture of polyethylene oxide and particles should not contain more than about 20 wt. % polyethylene oxide. In a preferred embodiment, the backing layer mixture comprises from about 5 wt. % to about 20 wt. % polyethylene oxide. In a most preferred embodiment, the mixture comprises from about 10 wt. % to about 20 wt. % polyethylene oxide.

Any submicron colloidal inorganic particles may be used in the backing layer mixture of the invention. Preferably, the particles are water dispersible. There may be used, for example, silica, alumina, titanium dioxide, barium sulfate, etc. In a preferred embodiment, silica particles are used.

The polymeric particles may in general comprise any organic polymeric material. Inorganic particles are in general too hard and are believed to dig into the receiving layer of adjacent receiver elements in a supply stack, preventing such particles from effectively controlling the sliding friction between adjacent receiver elements Particularly preferred polymeric particles are cross-linked polymers such as polystyrene cross-linked with divinyl benzene, and fluorinated hydrocarbon polymers. The polymeric particles are preferably from about 1 um to about 10 um in size, and particles of from about 3 um to about 5 um are particularly preferred for receiver elements having paper supports.

The backing layer may be present in any amount which is effective for the intended purpose. In general, good results have been obtained at a concentration of from about 0.5 to about 2 g/m$^2$.

The support for the dye-receiving element of the invention may be a polymeric, a synthetic paper, or a cellulosic paper support. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. In a further preferred embodiment, a polymeric layer such as a polyolefin layer may also be present between the paper support and the backing layer, e.g in order to prevent curl.

The dye image-receiving layer of the receiving elements of the invention may comprise, for example, a polycarbonate, a polyurethane, a polyester, polyvinyl ly(caprolactone) or mixtures thereof. The dye image-receiving layer may be present in any amount which is effective for the intended purpose. In general, good results have been obtained at a concentration of from about 1 to about 5 g/m$^2$. In a preferred embodiment of the invention, the dye image-receiving layer is a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl) propane, bis(4-oxyphenyl)methane, 1,1-bis(4-oxyphenyl) ethane, 1,1-bis(oxyphenyl)butane, 1,1-bis(oxyphenyl) cyclohexane, 2,2-bis(oxyphenyl)butane, etc. In a particularly preferred embodiment, a bisphenol-A polycarbonate having a number average molecular weight of at least about 25,000 is used. Examples of preferred polycarbonates include General Electric LEXAN® Polycarbonate Resin and Bayer AG MACROLON 5700®.

A dye-donor element that is used with the dye-receiving element of the invention comprises a support having thereon a dye containing layer. Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G®(product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine R® (product of Nippon Kayaku Co. Ltd.); basic dyes such as Sumicacryl Blue 6G® (product of Sumitomo Chemical Co., Ltd.), and Aizen Malachite Green®(product of Hodogaya Chemical Co., Ltd.);

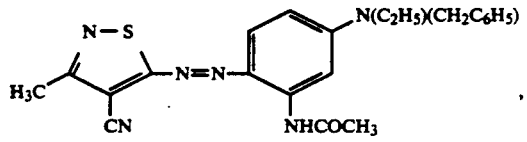

(magenta)

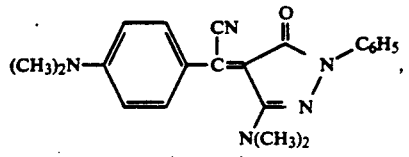

(magenta)

-continued

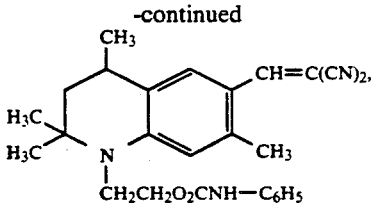

(yellow)

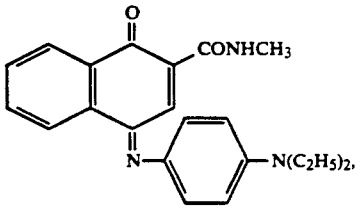

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate, butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 um. It may also be coated with a subbing layer, if desired.

A dye-barrier layer comprising a hydrophilic polymer may also be employed in the dye-donor element between its support and the dye layer which provides improved dye transfer densities. Such dye-barrier layer materials include those described and claimed in U.S. Pat. No. 4,700,208 of Vanier et.al., issued Oct. 13, 1987.

The reverse side of the dye-donor element may be coated with a slipping layer to prevent the printing head from sticking to the dye-donor element. Such a slipping layer would comprise a lubricating material such as a surface active agent, a liquid lubricant, a polymeric binder. Examples of such lubricating materials include oils or semi-crystalline organic ids that melt below 100° C. such as poly(vinyl stearate), beeswax, perfluorinated alkyl ester polyethers, phosphoric acid esters, silicone oils, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer, such as laser or ultrasound, may be used.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE

Dye-receivers were prepared by coating the following layers in order on white-reflective supports of titanium dioxide pigmented polyethylene overcoated paper stock:

(1) Subbing layer of poly(acrylonitrile-co-vinylidene chloride-co acrylic acid) (14:79:7 wt. ratio) (0.08 g/m$^2$) coated from butanone solvent.

(2) Dye-receiving layer of diphenyl phthalate (0.32 g/m$^2$), di-n-butyl phthalate(0.32 g/m$^2$), Fluorad FC-431 ® (a perfluorosulfonamido surfactant of 3M Corp.) (0.01g/m$^2$), Makrolon 5700 ® (a bisphenol-A polycarbonate of Bayer AG) (1.6 g/m$^2$), and a linear condensation polymer derived from carbonic acid, bisphenol-A, and diethylene glycol (phenol:glycol mol ratio 50:50, molecular weight approx. 17,000) (1.6 g/m$^2$) coated from dichloromethane solvent.

(3) Overcoat layer of Fluorad FC-431 ®(a perfluorosulfonamido surfactant of 3M Corp.) (0.02 g/m$^2$), DC-510 ® Silicone Fluid (a mixture of dimethyl and methylphenyl siloxanes of Dow Corning) (0.02 g/m$^2$) in the linear condensation polymer described above (0.22 g/m$^2$) coated from dichloromethane solvent.

On the reverse (back) side of these supports a layer of high-density polyethylene (32 g/m$^2$) was extrusion coated. On top of this layer, backing layers of the invention or comparison backing layers were coated from a water and isobutyl alcohol solvent mixture. The backing layers contained polyethylene oxide (POLYOX ® series of Union Carbide, molecular weight 100,000)(0.13 g/m$^2$), colloidal silica (LUDOX AM ® alumina modified colloidal silica of duPont)(0.9 g/m$^2$) of approximately 0.014 um diameter, and larger particles of average sizes, concentrations, and compositions indicated below. For coating ease, all backing layers also contained Triton X-200 ® (a sulfonated aromatic-aliphatic surfactant of Rohm and Haas) (0.09 g/m$^2$) and Daxad-30 ® (sodium polymethacrylate of W. R. Grace Chem. Co.) (0.02 g/m$^2$).

| Receiver Element | Larger Particles |
|---|---|
| C-1 (Control) | None |
| E-1 (Invention) | Polystyrene:divinyl benzene beads (Cross-linked, 95:5 mol ratio) (3.0 um, 1.4 g/m$^2$) |
| E-2 (Invention) | Polystyrene:divinyl benzene beads (Cross-linked, 95:5 mol ratio) (3.0 um, 0.6 g/m$^2$) |
| E-3 (Invention) | Polystyrene:divinyl benzene beads (Cross-linked, 95:5 mol ratio) (3.0 um, 0.23 g/m$^2$) |
| E-4 (Invention) | Polystyrene:divinyl benzene beads (Cross-linked, 95:5 mol ratio) (3.0 um, 0.06 g/m$^2$) |
| E-5 (Invention) | Polystyrene beads (3.0 um, 0.23 g/m$^2$) |
| E-6 (Invention) | Aqua Polyfluo 411 ® (Micro Powders, (Inc.) (mixture of polyethylene and polytetrafluoroethylene) (3.0 um, 0.23 g/m$^2$) |
| E-7 (Invention) | Superslip 6530 ® (Micro Powders, (Inc.) (a polyethylene amide) (3.0 um, 0.23 g/m$^2$) |
| E-8 (Invention) | Aqua Polysilk 19 ® (Micro Powders, Inc.) (fluoroinated hydrocarbon polymixture) (4.0 um, 0.23 g/m$^2$) |
| C-2 (Comparison) | Syloid 244 ® (Grace Chemical) (silica particulate material) (2.0 um, 0.23 g/m$^2$) |
| C-3 (Comparison) | Zeospheres ® (Engelhard) (aluminum silicate material) (3.0 um, 0.27 g/m$^2$) |

To evaluate receiver backing layer to rubber picking roller friction, each dye receiver tested was placed face down (dye image-receiving layer side down) on top of a stack of face down receivers. Two pick rollers (12 mm wide and 28 mm in diameter with an outer 2 mm layer of Kraton ® G2712X rubber) of a commercial thermal printer (Kodak ® SV6500 Color Video Printer) were lowered onto the top test receiver so as to come into contact with the backing layer to be tested. The rollers were stalled at a fixed position so that they could not rotate, and supplied a normal force of approximately 4 N (400 g) to the receiver backing layer. Before testing, the pick-rollers were cleaned with water and dried. A spring type force scale (Chatillon 2 kg×26 g scale) was attached to the test receiver and was used to pull it at a rate of 0.25 cm/sec from the receiver stack. Clean sections of the rollers were used for each test as any contamination of the rollers could significantly alter the measured friction. The required pull forces for the various backing layers were measured as the receivers began to slide and are indicated in the table below. In actual practice, it has been found that pull forces of at least about 6 N (600 g) or more are preferable to ensure good picking reliability.

To evaluate sliding friction between the backing layer of one receiver element and the receiving layer of an adjacent element, a first receiver element was taped to a stationary support with the backing layer facing up. A second receiver element was then placed with its receiving layer face down against the backing layer of the first element. A 1.54 steel weight was placed over the two receiver elements, covering an area approximately 10 cm by 12 cm. A cam driven strain gauge was attached to the second (upper) receiver element and advanced about two cm at a rate of 0.25 cm/sec. The maximum pull forces for the various receivers were measured at about 1 sec into the pull and are indicated in the table below. In actual practice, it has been found that pull forces of less than about 5 N (500 g) are desirable to prevent blocking or multiple feeding.

To evaluate sticking between a receiver backing layer and a dye-donor, a high-density image was printed using a Kodak ® SV6500 Color Video Printer and having the receiver being tested inserted wrong-side up. A dye-donor having lacerating sequential areas of cyan, magenta and yellow dye similar to that described in Example 2 of copending, commonly assigned U.S. Ser. No. 345,049 of Bailey et.al., filed Apr. 28, 1989, which is hereby incorporated by reference, was used. The dye donor was brought into contact with the backing layer of a receiver, and the assemblage was clapped to the stepper-motor driven rubber roller of the Color Video Printer. The thermal print head of the printer was pressed against the dye-donor element side of the assemblage pushing it against the rubber roller. The printer's imaging electronics were activated causing the assemblage to be drawn between the print head and roller, and a stepped density pattern was generated by pulsing the resistive elements in the thermal print head at varying rates, similar to the printing procedure described in Example 2 of U.S. Ser. No. 345,049 incorporated by reference above. Ideally, no sticking of the donor to the receiver backing layer should occur where a print is attempted when the receiver is accidentally inserted wrong side up The test results for sticking to the various backing layers are given in the table below.

| Receiver Element | Picking Friction (Newtons) | Sliding Friction (Newtons) | Sticking to Donor | Blocking |
|---|---|---|---|---|
| C-1 | 7.8 | 5.5 | None | Yes |
| E-1 | 6.0 | 4.0 | None | No |
| E-2 | 7.0 | 3.8 | None | No |

-continued

| Receiver Element | Picking Friction (Newtons) | Sliding Friction (Newtons) | Sticking to Donor | Blocking |
|---|---|---|---|---|
| E-3 | 7.0 | 3.9 | None | No |
| E-4 | 7.5 | 4.5 | None | No |
| E-5 | 7.0 | 4.3 | None | No |
| E-6 | 7.6 | 3.6 | None | No |
| E-7 | 7.2 | 3.9 | None | No |
| E-8 | 7.0 | 3.0 | None | No |
| C-2 | 7.5 | 5.5 | None | Yes |
| C-3 | 7.5 | 5.5 | None | Yes |

The above results demonstrate that backing layers of polyethylene oxide mixed with submicron colloidal inorganic particles and larger polymeric particles provide improved combined picking and sliding friction characteristics.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a support having on one side thereof a polymeric dye image-receiving layer and on the other side thereof a backing layer, the improvement wherein said backing layer comprises a mixture of polyethylene oxide, submicron colloidal inorganic particles, and polymeric particles of a size larger than the inorganic particles.

2. The element of claim 1, wherein said support comprises paper.

3. The element of claim 2, further comprising a polyolefin layer between said support and said backing layer.

4. The element of claim 2, wherein said polymeric particles have an average size of from about 3 um to about 5 um.

5. The element of claim 1, wherein said inorganic particles comprise silica.

6. The element of claim 5, wherein the polymeric particles comprise cross-linked polystyrene.

7. The element of claim 5, wherein the polymeric particles comprise a fluorinated hydrocarbon polymer.

8. The element of claim 1, wherein the polymeric particles comprise cross-linked polystyrene.

9. The element of claim 1, wherein the polymeric particles comprise a fluorinated hydrocarbon polymer.

10. The element of claim 1, wherein said polymeric particles have an average size of from about 1 um to about 10 um.

11. In a process of forming a dye transfer image in a dye-receiving element comprising:

(a) removing an individual dye-receiving element comprising a support having on one side thereof a polymeric dye image-receiving layer and on the other side thereof a backing layer from a stack of dye-receiving elements;

(b) moving said individual dye-receiving element to a thermal printer printing station and into superposed relationship with a dye-donor element comprising a support having thereon a dye-containing layer so that the dye-containing layer of the donor element faces the dye image-receiving layer of the receiving element; and (c) imagewise-heating said dye-donor element and thereby transferring a dye image to said individual dye-receiving element;

the improvement wherein said backing layer comprises a mixture of polyethylene oxide, submicron colloidal inorganic particles, and polymeric particles of a size larger than the inorganic particles.

12. The process of claim 11, wherein the receiving element support comprises paper.

13. The process of claim 12, wherein said receiving element further comprises a polyolefin layer between the paper support and the backing layer.

14. The process of claim 12, wherein said polymeric particles have an average size of from about 3 um to about 5 um.

15. The process of claim 11, wherein the inorganic particles comprise silica.

16. The process of claim 15, wherein the polymeric particles comprise cross-linked polystyrene.

17. The process of claim 15, wherein the polymeric particles comprise a fluorinated hydrocarbon polymer.

18. The process of claim 11, wherein the polymeric particles comprise cross-linked polystyrene.

19. The process of claim 11, wherein the polymeric particles comprise a fluorinated hydrocarbon polymer.

20. The process of claim 11, wherein said polymeric particles have an average size of from about 1 um to about 10 um.

* * * * *